US005245333A

United States Patent [19]

Anderson et al.

[11] Patent Number: 5,245,333

[45] Date of Patent: Sep. 14, 1993

[54] THREE WIRE LOW POWER TRANSMITTER

[75] Inventors: Stephen D. Anderson, Minneapolis; Roger L. Frick, Hackensack; Glen E. Monzo, Minneapolis; Brian L. Westfield, Eden Prairie, all of Minn.

[73] Assignee: Rosemount Inc., Eden Prairie, Minn.

[21] Appl. No.: 766,667

[22] Filed: Sep. 25, 1991

[51] Int. Cl.[5] ..... G06C 19/00

[52] U.S. Cl. ..... 340/870.30; 340/870.16; 340/870.38

[58] Field of Search ..... 340/870.18, 870.30, 340/870.38, 870.01, 870.16, 870.21, 870.26, 870.39; 455/115; 323/293

[56] References Cited

U.S. PATENT DOCUMENTS

| | | | |
|---|---|---|---|
| 3,948,098 | 4/1976 | Richardson et al. | 340/870.3 |
| 4,339,750 | 7/1982 | Delacruz | 340/870.37 |
| 4,598,381 | 7/1986 | Cucci | 364/558 |
| 4,791,352 | 12/1988 | Frick et al. | 324/60 CD |
| 4,804,958 | 2/1989 | Longsdorf | 340/870.16 |

OTHER PUBLICATIONS

"Model 1151 Low Power Pressure Transmitters", Rosemount Inc. Measurement Division, 1982, 1983, 1986.

Hart® Smart communications Protocol Data Link Layer Specification, Rev. 7.0, Document No. D8900098; Rev A, Jan. 22, 1990.

Hart® Smart Communications Protocol voltage Mode Physical Layer Specification, Rev. 1.0-Final, Document No. D9000062; Rev A, Nov. 5, 1990.

Hart® Smart Communications Protocol Hart Physical Layer Specification, Rev. 7.1-Final, Document No. D8900097; Rev B, Jun. 25, 1990.

*Primary Examiner*—Donald J. Yusko
*Assistant Examiner*—Michael Horabik
*Attorney, Agent, or Firm*—Kinney & Lange

[57] ABSTRACT

A three wire transmitter bidirectionally communicates AC signals to and from a first external device and sends DC signals to a second external device. The transmitter includes a communication circuit which is energized from power and common terminals and includes memory storage for transmitter status and a process variable (PV). The communication circuit receives a sensor output indicative of the PV and provides the DC signal and the AC signal to a signal terminal which connects to both external devices, and also receives AC signals from the first external device. The communications circuit has a characteristic AC impedance between the signal and common terminals over an AC frequency range for receiving and transmitting AC signals to and from the first external device so that the receiving signals are not shorted out and so the transmitted signals can be received. The communications circuit has a characteristic DC impedance between the signal and common terminals over a range of frequencies which include DC and typically extend to approximately 20 Hz. The characteristic impedance is substantially lower than the impedance of the second external device which receives DC signals so that the accuracy of the DC signal is not compromised.

11 Claims, 4 Drawing Sheets

THREE WIRE LOW POWER TRANSMITTER

BACKGROUND OF THE INVENTION

This invention relates to process variable transmitters receiving power over two of three wires and communicating over a third wire to a controller.

SUMMARY OF THE INVENTION

A three wire transmitter bidirectionally communicates AC signals to and from a first external device and sends DC signals to a second external device. The transmitter has power and common terminals which connect to corresponding power and common terminals of an external energization source. The transmitter includes sensing means which are energized from the power and common terminals, for providing a sensor output indicative of a process variable (PV) sensed by the sensing means. Also included are communication means energized from the power and common terminals, including memory storage for transmitter status and PV. The communication means receives the sensor output and provides the DC signal and the AC signal to a signal terminal which connects to both external devices, and also receives AC signals from the first external device. The DC signal is representative of the sensed PV, over a range of frequencies which include DC, and the AC signal is digitally representative of the sensed PV and of transmitter data selected by the received AC signal. The communications means have a characteristic AC impedance between the signal and common terminals over an AC frequency range for receiving and transmitting AC signals to and from the first external device so that the receiving signals are not shorted out and so the transmitted signals can be received. The communications means have a characteristic DC impedance between the signal and common terminal over a range of frequencies which include DC and typically extends to about 20 Hz. The DC characteristic impedance is substantially lower than the impedance of the second external device which receives DC signals so that the accuracy of the transmitted DC signal is not compromised. In one application, the functions of the first and the second external device are combined.

A microcomputer is included in the communication means which stores the transmitter status information. The microcomputer also receives and sends the transmitter status information. A pulse width modulation circuit encodes the DC signal. A modem is included in the communication means for FSK encoding the sensor output. A wave shaping circuit may be included which shapes the FSK encoded signal according to the HART ® communications standard.

DETAILED DESCRIPTION OF THE PREFERRED EMBODIMENTS

Figure 1:
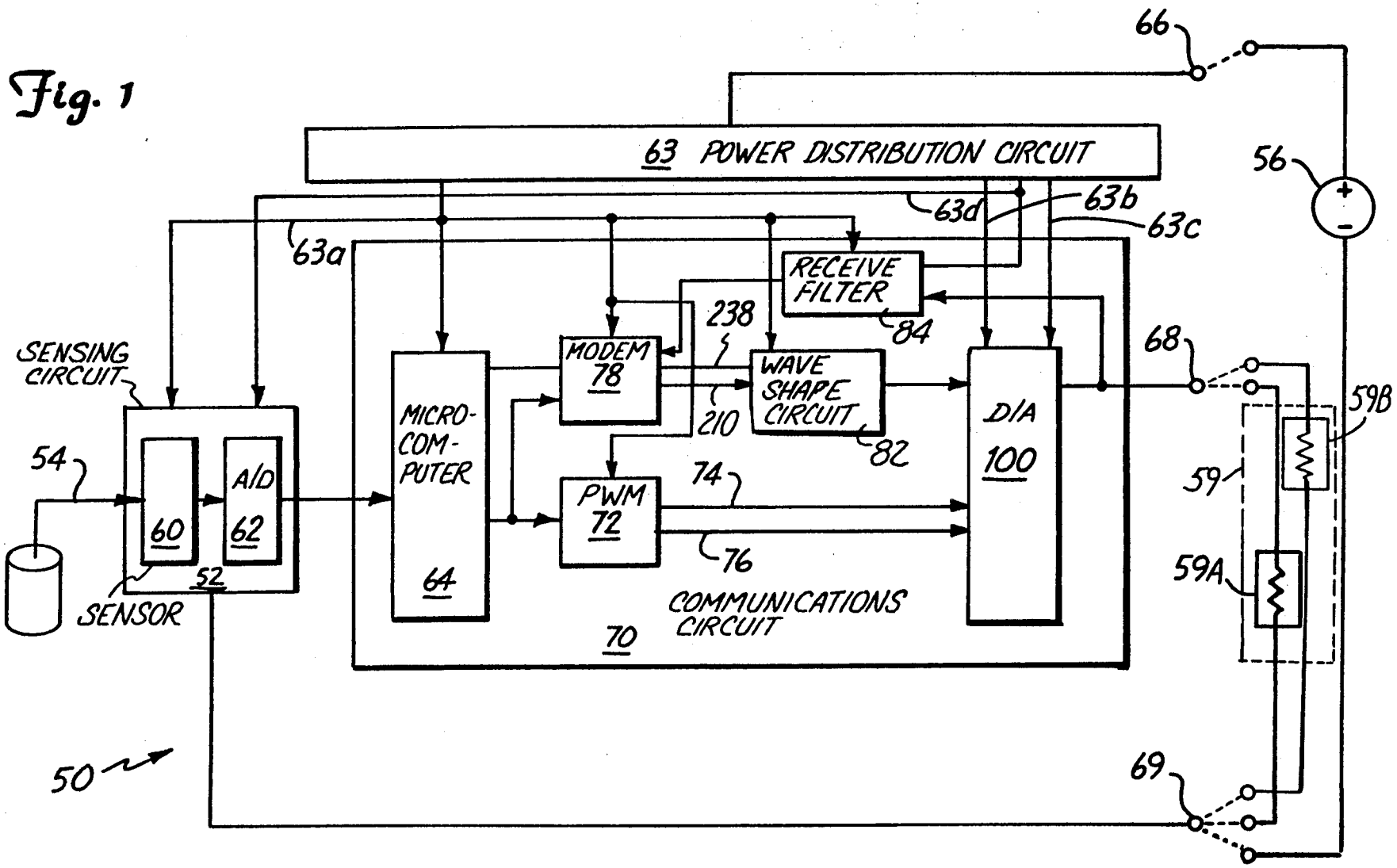
FIG. 1 is a circuit block diagram of a transmitter made according to the present invention.

In FIG. 1, a first embodiment of three wire transmitter 50 includes sensing circuit 52 which senses process variable 54, such as pressure, temperature, level, flow, pH or the like. Three wire transmitter 50 operates in a process control application in the field. Power is supplied to it from an external energization source 56, which is typically a 6V or 12V solar battery having a limited current sourcing ability. Consequently, transmitter 50 preferably consumes a small amount of power. Furthermore, in many applications several transmitters 50 are powered by the same supply, making power consumption even more critical. In the preferred embodiment, power drawn from the energization source 56 does not exceed 0.04 Watts.

In operation of transmitter 50, an external device 59A is connected to transmitter signal output 68. A first type of external device is a hand held communicator which sends AC signals to transmitter 50 which select transmitter status, performance data and PV value stored in microcomputer 64. In response, transmitter 50 sends an AC signal representative of the data selected by the hand held communicator. The AC signals are communicated in the HART ®protocol, defined in Rosemount Inc. HART ® Smart Communications Protocol Data Link Layer Specification, but alternate embodiments of transmitter 50 communicate by other protocols.

A second type of external device 59B couplable to signal output 68 is a controller. In one such application, transmitter 50 provides a DC signal representative of the sensed process variable 54 to signal output 68. The DC signal is typically transmitted in a 1–5V protocol where the output potential is representative of process variable 54, but alternate current or voltage signalling standards can be employed, such as 0.8–3.2V. This type of external device has a characteristic input impedance typically greater than 100KΩ over a range of frequencies including DC and lo extending to 20 Hz. In another controller application, transmitter 50 sends an AC signal representative of the sensed process variable to signal output 68. The AC signal is typically transmitted according to the HART ® protocol, but other alternate AC protocols are available.

Functions of the hand-held communicator and the controller may be combined into a single external device 59, because signal terminal 68 couples to both devices 59A and 59B. Alternatively, the hand-held communicator external device 59A or the controller external device 59B may be connected to signal terminal 68.

Sensing circuit 52 preferably includes a sensor 60 for detection of process variable 54, which in this application is level. Typically, output of sensor 60 is an analog signal which is digitized by analog-to-digital (A/D) converter circuit 62. Preferred low power A/D circuits for process control applications are disclosed in U.S. Pat. No. 4,791,352, titled "Transmitter with Vernier Measurement", owned by the same assignee as the instant application. Process control applications typically require that the A/D converter consume a small amount of power, have relatively high resolution, fast update rates and employ a minimum number of signal lines to communicate the digitized result.

Sensing circuit 52 is powered by power distribution circuit 63, which includes filtered 5V supply 63*a* for general distribution to other circuits in transmitter 50, 1.235V supply reference 63*b*, DC-DC converter supply 63*c* for analog circuitry and 2.5V reference supply 63*d*.

Distribution circuit 63 receives power from power terminal 66, which is couplable to the corresponding power terminal of external power supply 56. Common terminal 69 is couplable to the common terminal of power supply 56. External device 59 need not share power supply 56 with transmitter 50, but must share common terminal 69.

Communications circuit 70 includes microcomputer 64 which receives and stores the digitized output of A/D circuit 62. Preferably, microcomputer 64 includes storage capability for storing constants relating to status and performance of transmitter 50. Alternatively, the constants are stored in an external EEPROM and communicated to microcomputer 64. Performance related constants relate known errors in sensor 60 performance as a function of the desired process variable so that microcomputer 64 provides a 14 bit wide digital output compensated for such errors which is representative of process variable 54. Compensation methods for transmitters are well known and documented in U.S. Pat. No. 4,598,381 to Cucci, owned by the same assignee as the instant application. Status information about transmitter 50 includes the manufacturing location, date of manufacturing and other pertinent information.

Pulse width modulation (PWM) circuit 72 receives the 14 bit wide digitally compensated microcomputer output and stores seven upper bits and seven lower bits in separate registers therein. Combinational logic in circuit 72 converts contents of each of the registers into two pulse width encoded outputs, called OMSB and OLSB and shown at 74,76, respectively. The magnitude of the register contents is proportional to the width of the pulse. The magnitude of the pulse width encoded word can be a maximum of $2^7$, or equivalently, 128 clock pulses long. For example, if the magnitude of the compensated sensor output is 583, or equivalently $1001000111_2$, circuit 72 splits such output into an upper word of $100_2$ and a lower word of $1000111_2$. Circuit 72 output for the upper word, OMSB, is a pulse of four clock cycles duration, transmitted within a fixed time of 128 clock cycles. In likewise fashion, circuit 72 output for the lower word, OLSB, is a pulse of width 71 clock cycles out of 128 cycles. Circuit 72 is preferably designed of CMOS logic and is an Application Specific Integrated Circuit (ASIC) in order to reduce current consumption.

The digitally compensated microcomputer output representative of the sensed process variable is also coupled to modem 78 which encodes the sensor output according to Bell 202 standard, published by AT&T in Bell System Data Communications Technical Reference, Data Sets 202S and 202T Interface Specification, July 1976. Modem 78 provides phase continuous modulation according to the specification and is available from NCR Microelectronics Division in Fort Collins, Col. as Bell 202 Modem ASIC, Part Number 609-0380923. The modulated output of modem 78, signal 210, is sent to wave shaping circuit 82 for shaping to conform to the HART ® Smart Communications Protocol Voltage Mode Physical Layer Specification, Rev. 1.0-Final, Section 7.1.2 Transmitted Wave Form. Three wire transmitter 50 may employ other communications standards appropriate for the process control industry, such as MODBUS ® or DE protocols. MODBUS ® is a registered trademark of Gould Technology, Inc. and DE is a process industry protocol developed by Honeywell, Inc. In such embodiments, wave shaping circuit 82 is designed to meet the signal shape requirements defined in those respective standards.

Receive filter 8 receives requests for performance and status data stored in microcomputer 64 from external device 59. The request is typically FSK encoded and is decoded by modem 78 before being sent to microcomputer 64.

Digital and analog output circuit 100 receives the DC pulse width modulated signals representative of process variable 54 and wave shaped AC signals. Circuit 100 effectively superimposes the output of wave shape circuit 82 onto the sum of outputs 74,76 and couples the resulting simultaneous analog and digital signals to transmitter signal output 68. If transmitter 50 is not responding to a request for information from external device 59, and so will not transmit an AC signal representative of the response of such request, then transmitter 50 transmits the DC signal representative of the sensed process variable alone.

Figure 2:
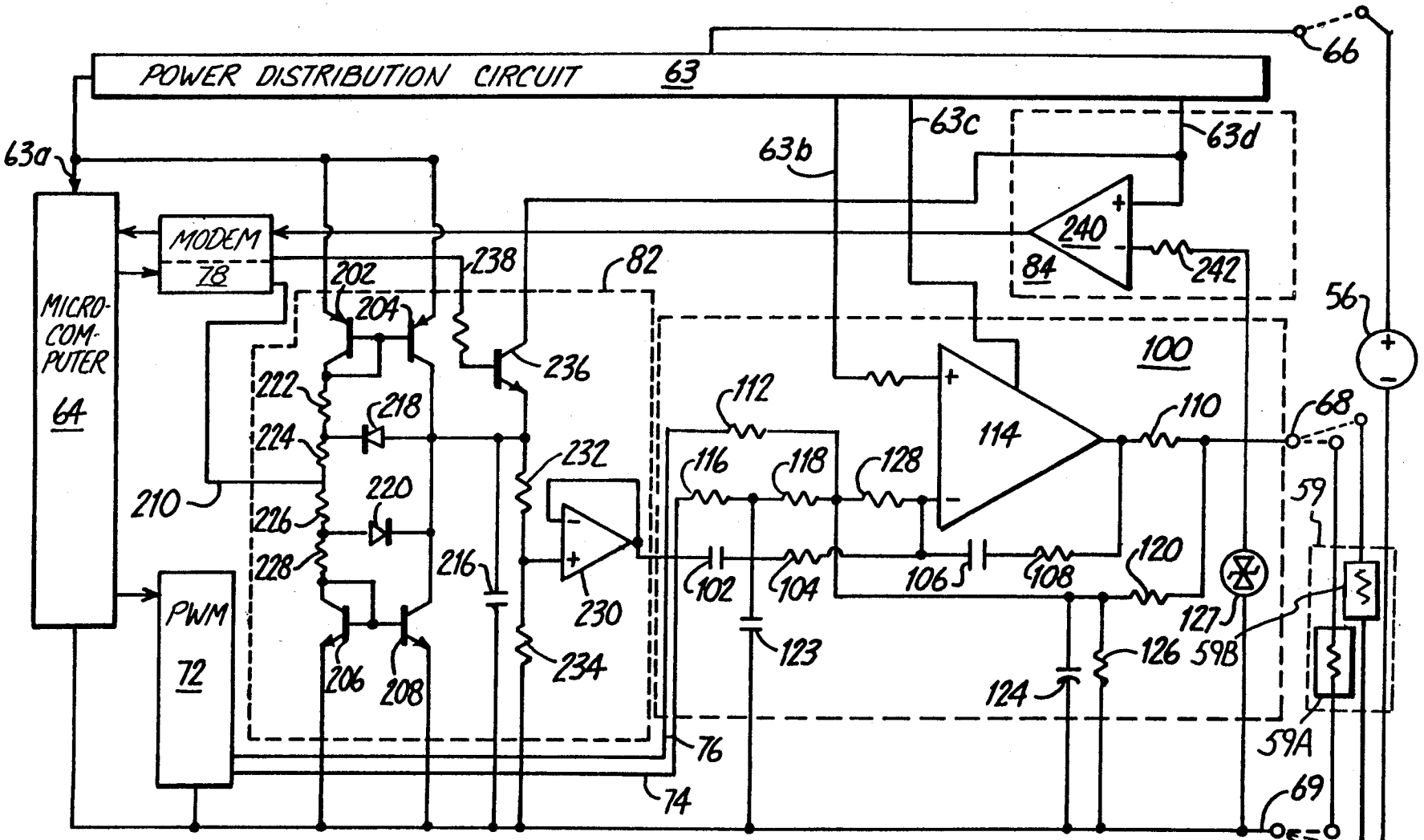
FIG. 2 is a detailed schematic of transmitter 50 shown with the external device and energization device shown in FIG. 1.

In FIG. 2, wave shaping circuit 82 is detailed. An upper current mirror is formed by PNP transistors 202,204 and a lower current mirror is formed by NPN transistors 206,208. Mirrors such as these are conveniently available in many bipolar integrated circuit arrays and generally available in off-the-shelf transistor arrays. Signal 210, the modulated output from modem 78, couples to wave-shaping circuit 82 and is a square wave having an amplitude between the potential at common terminal 69 and substantially the same potential as at the filtered 5V supply, 63*a*. Signal 210 has extremely short rise and fall times, characteristic of most CMOS devices. When the potential of input signal 210 is at a maximum, transistors 206,208 of the lower current mirror are conducting and transistors 202,204 of the upper current mirror are turned off. Similarly, when the potential of input signal 210 is at a minimum, transistors 206,208 of the lower current mirror are turned off and transistors 202,204 of the upper current mirror are conducting.

When transistors in the upper mirror are conducting, capacitor 216 is charged. When transistors in the lower mirror are conducting, a discharge current flows from capacitor 216 to common terminal 69. Diodes 218,220 clamp the potential of capacitor 216. If the potential at capacitor 216 increases toward the potential at supply 63*a*, diode 218 will eventually turn on and conduct the upper mirror current that would otherwise have gone into capacitor 216, thus flattening the top portion of the potential across capacitor 216. Similarly, if the potential at capacitor 216 is decreasing toward the potential at common terminal 69, diode 220 will eventually turn on and conduct the lower mirror current, thus flattening the bottom of the potential waveform. This results in a trapezoidal voltage waveform at the wave-shape circuit output, as shown at 306 in FIG. 3.

The potential at which diode 218 starts conducting is determined by the relative values of resistors 222,224 and by the base-emitter drop of transistors 202,204. The same two resistors and the base-emitter drop also set the upper mirror current. Likewise, the potential at which diode 220 starts conducting is determined by the relative values of resistors 226,228, and the base-emitter voltage drop of transistors 206,208. The value of resistors 226,228 and the base-emitter drop similarly determine the lower current mirror current. In the absence of diodes 218,220, capacitor 216 would integrate these currents to produce a triangular-shaped voltage waveform at the wave-shaping circuit output. The rate of rise of the output of circuit 82 is determined by the mirror current and value of capacitor 216. The mirror current through each side of the current mirror is approximately 20μS when transmitter 50 transmits AC signals and 10μS when not transmitting AC signals. The value of capacitor 216 is chosen to be approximately 1000 pF, so that the effective RC time constant of circuit 82 meets HART waveform requirements.

Resistors 232,234 form a resistive divider to reduce the absolute magnitude of the potential across capacitor 216. The value of resistors 232,234 are selected so as to meet the waveform specification defined in HART® Smart Communications Protocol Physical Layer Specification and are of significant resistance to minimize the RC time constant of the output waveform of circuit 82. When transmitter 50 sends AC communications, control signal 238 from modem 78 turns off transistor 236. Control signal 238 is preferably because when modem 78 is idle, modem output 210 has a high impedance which would allow the potential at capacitor 216 to decrease to the potential of the collector-emitter junction of transistor 208, thereby creating a short glitch on output 68 when the next sequence of AC communications was initiated.

Figure 3:
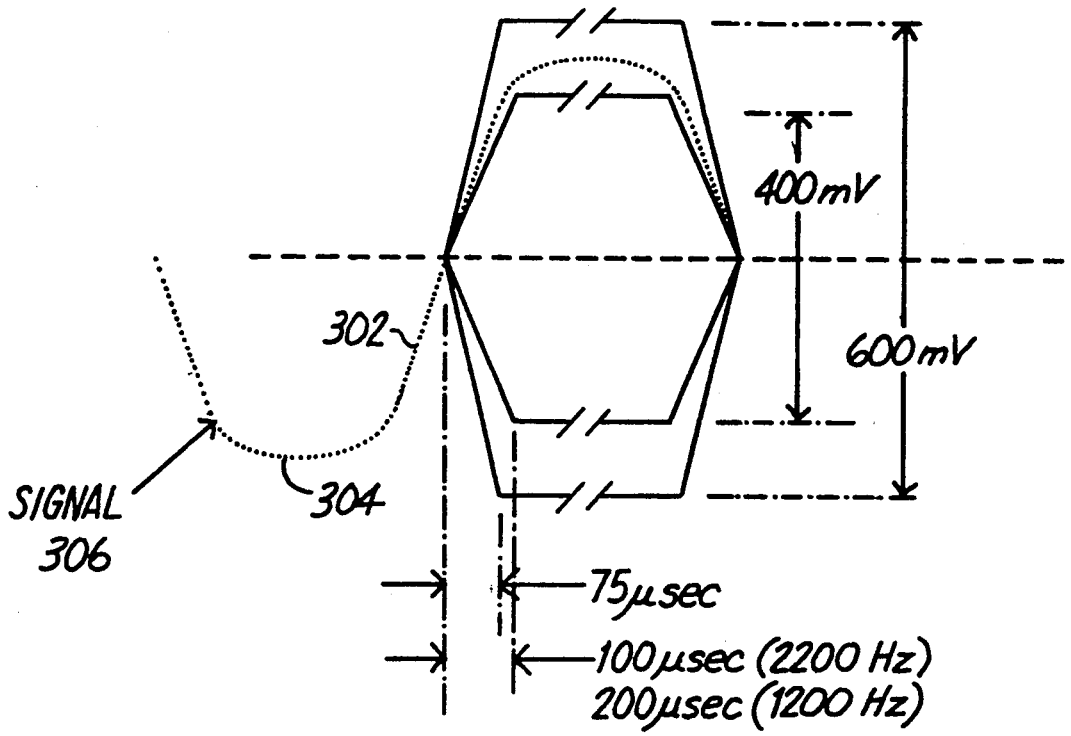
FIG. 3 is a sketch of the output waveform of wave shaping circuit 82 shown in FIG. 2.

The arrangement of the diode 218,220 and the mirrors provide a sharp transition between the ramping and the flattened part of the output waveform, shown respectively at 302,304 in FIG. 3. As current flow through a diode begins, the corresponding mirror set current is reduced by the same amount. The current that would otherwise flow into capacitor 216 is not only being diverted, but is simultaneously reduced. In most circuits which utilize diode clamps, the clamp voltage has a strong dependence on temperature because of the temperature dependence of the potential difference across the diode. The circuit in wave-shaping circuit 82 provides some cancellation of the diode voltage drop variation, thus making peak-to-peak capacitor potential 216 substantially stable with temperature. For example, suppose that the base-emitter potential drop of transistors 202,204 decreases due to an increased temperature, as would the potential difference across diode 218. However, the voltage at the junction of diode 218 and resistors 222,224 would decrease. The variation in capacitor potential 216 when diode 218 is conducting is approximately the sum of these two opposing variations, and is therefore substantially constant.

The current consumption of wave shaping circuit 82 is determined entirely by the set current and can be made arbitrarily small, depending upon the loading of capacitor 216. Heavier loads will draw more current away from integrating capacitor 216, necessitating larger mirror set currents to maintain an acceptable waveshape. High-impedance buffer 230 provides a low impedance signal to circuit 100, reducing current consumption of wave shaping circuit 82. Circuit 82 minimizes the high frequency energy content of the waveform by ensuring that no sharp signal transitions occur. This is preferable because the high frequency energy content of the waveform contributes to AC signalling cross-talk between multiple transmitters having adjacent power and communication lines.

The specification for wave shaped output of circuit 82 is given in the above referenced HART® Smart Communications Protocol Physical Layer Specification. The amplitude of the wave shaped signal must be between 400 mV and 600 mV peak-to-peak as measured across a HART defined test load of 500Ω in series with a 10 μF capacitor, the rise time must be between 75 μS and 100 μS when transmitting 2200 Hz and less than 200 μS when transmitting 1200 Hz. The amplitude and rise time specifications limit crosstalk, which is particularly critical when the power connections of multiple transmitters share the same cable.

In FIG. 2, receive filter 84 includes op-amp 240 and resistor 242. Resistor 242 has a large enough impedance so that the parallel combination of resistors 242,110 appears as an effective open circuit to the rest of the circuitry in transmitter 50. The value of resistor 242 must be large enough so that incoming AC signals from external device 59 are not shorted out. Zener 27 prevents damage to transmitter 50 circuitry if a supply were connected to terminal 68.

Output circuit 100 passes the wave shaped signal from circuit 82 through a band pass filter, comprising capacitor 102, resistor 104, capacitor 106 and resistor 108, designed to pass substantially those frequencies between the FSK frequencies 1200 and 2200 Hz as required in the Bell 202 standard. The band pass filtered signal is connected to signal output 68 through resistor 110.

Circuit 100 must perform desired transmitter functions as well as meet HART physical layer standards. The first requirement is that circuit 100 present an output impedance between 1000 and 2000 ohms as seen between terminal 68,69 over the HART defined Extended Frequency Band of 500 Hz to 10 kHz. Secondly, it must also present an impedance of substantially zero ohms at terminal 68 at frequencies of 20 Hz or less. Thirdly, it must filter signals 74,76 and provide a substantially DC output. Fourthly, circuit 100 must provide such filtered signals to terminal 68 at a prescribed level of gain. Lastly, the AC signal must be superimposed on top of the substantially DC signal and the AC signal must have a prescribed gain.

Figure 4:
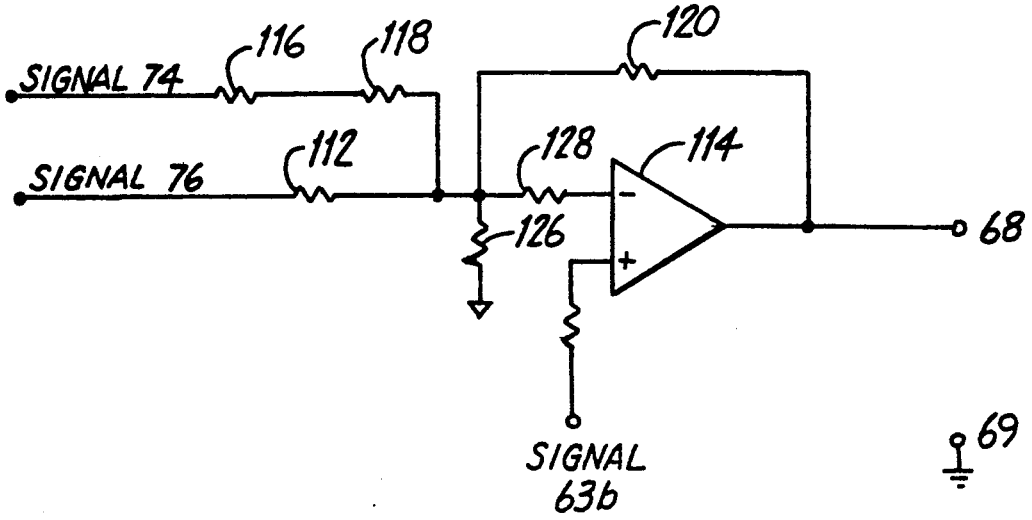
FIGS. 4 and 5 low frequency and high frequency equivalent circuits of circuit 100, respectively.

In FIG. 4, an equivalent circuit 100 is shown for low frequencies and DC. The resulting output impedance at terminal 68 with respect to terminal 69 is nearly zero, as required for transmitting the DC signal. Resistor values 112,118,120,126 and 116 are selected so that when OLSB and OMSB (signal 76,74, respectively) are all zeros, the sum of the current flowing through resistors 112,116,118 to circuit 72 and through resistor 126 towards common terminal 69 equals the current through resistor 120, so that the potential at signal output 68 is approximately 6.0V. Similarly, when OLSB and OMSB are all ones, the difference between the current flowing into the summing junction through resistors 112,116,118 and the current through resistor 126 is substantially equal to the current through resistor 120 so that the DC output at signal terminal 68 is approximately 0.5V. Capacitors 123,124, shown in FIG. 2, provide low pass filtering of the inherently noisy OLSB and OMSB signals so that the pulse width modulation is removed and only a DC current flows into the summing junction where resistors 118,126,112,128,120 join.

Figure 5:
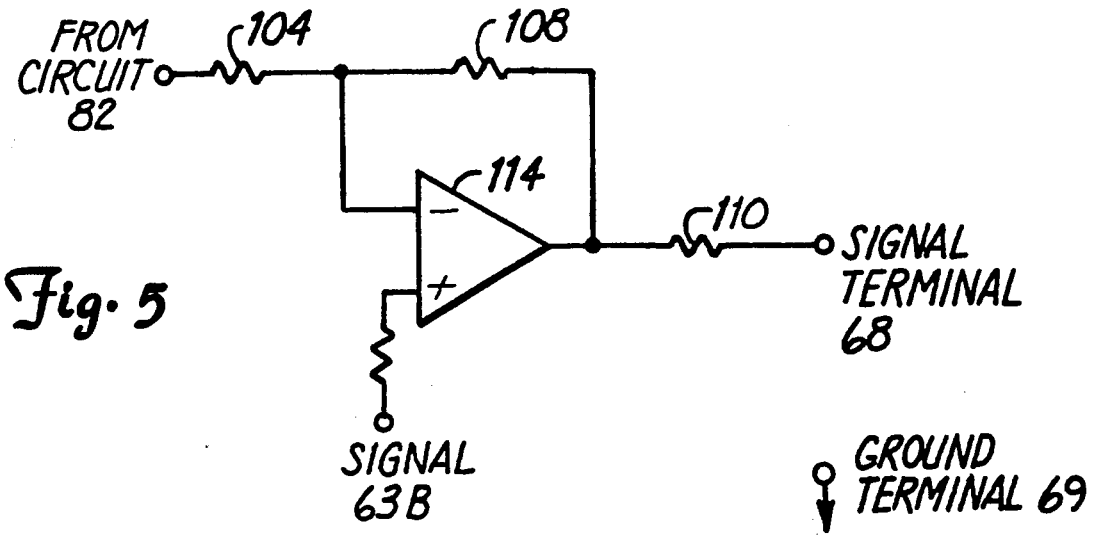

In FIG. 5, equivalent circuit 100 for higher frequencies is shown. Several components shown in FIG. 2 are absent from this model. For example, capacitor 124 is substantially a short circuit and effectively removes the feedback path through resistor 120 and isolates resistor 110 from feedback. Resistor 110 appears in series with opamp 114 output. By choosing resistor 110 to be in the range between 1000 to 2000 ohms, the first requirement is satisfied. Capacitor 102,106 of circuit 100 become effective short circuits so that with proper selection of resistors 104,108, a specified gain can be achieved for the transmitted AC signal.

Figure 6:
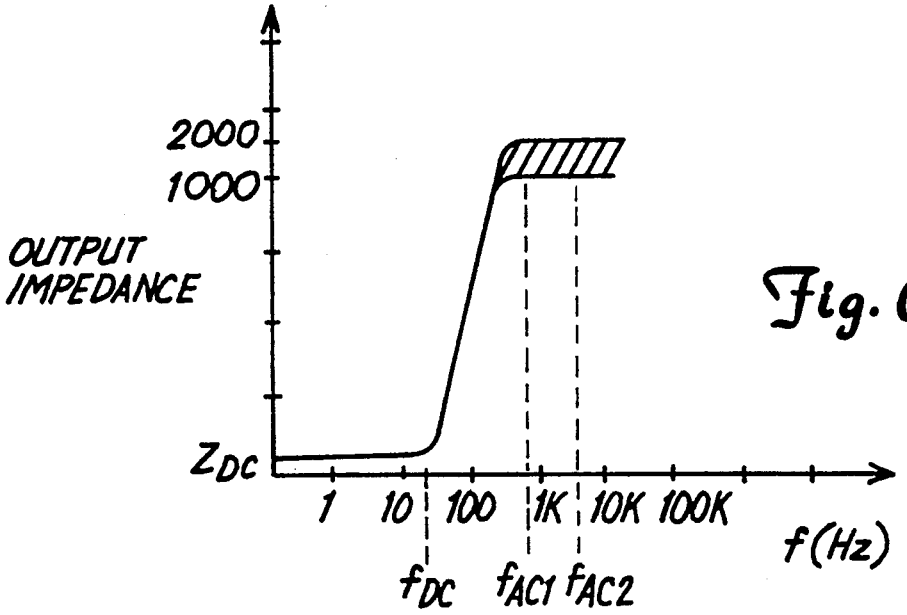
FIG. 6 is a sketch of transmitter 50 output impedance as a function of frequency, as seen between terminals 68,69.

FIG. 6 shows the output impedance of transmitter 50, as a function of frequency in Hz, seen by external device 59 between output terminal 68 and common terminal 69. For frequencies less than $f_{DC}$, the output impedance must be substantially less than the input impedance of DC receiving external device 59, in order to transmit the effectively DC signal into a minimum of 100KΩ. In general, the output impedance of transmitter 50 is significantly lower than the DC input impedance of external device 59 so that accuracy of the transmitted DC signal is not compromised. For the HART protocol, $f_{DC}$ is 20Hz and $Z_{DC}$ is substantially zero ohms. The 100Ω is specified in the above referenced HART® Smart Communications Protocol Voltage Mode Physical Layer Specification Section 7.3. For example, if the input impedance of DC receiving external device 59 is 100kΩ and the required DC accuracy is 0.1% of the output span of transmitter 50, then the output impedance must be less than 100kΩ multiplied by 0.001, or 100Ω for frequencies between 0 and 20 Hz.

Figure 7:
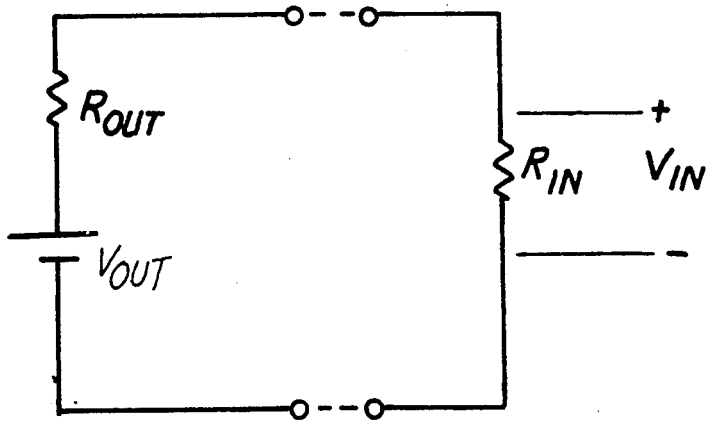
FIG. 7 is a schematic of a model circuit for illustrating transmitter accuracy.

In FIG. 7, the output impedance of transmitter 50 is shown as resistor $R_{out}$ and voltage potential $V_{out}$ is the desired effectively DC output potential of transmitter 50. Resistor $R_{in}$ represents the input impedance of DC receiving external device 59, and the measured potential across $R_{in}$ is defined as $V_{in}$. In order for transmitter 50 to maintain 0.1% accuracy over the full range of possible effectively DC output signals, $$V_{IN} = V_{out} \times \frac{R_{IN}}{R_{out} + R_{IN}}$$

This is approximately equivalent to the following equation for $R_{out}$ much less than $R_{in}$: Or, $$1 - \frac{R_{out}}{R_{IN}} > 0.999$$

$$R_{out} < 0.001\ R_{IN}$$

in order for transmitter 50 to transmit with 0.1% accuracy.

For transmitted and received frequencies within the HART defined extended frequency band (500–10kHz), shown at $f_{AC1}$ and $f_{AC2}$ on FIG. 6, output impedance is between 1000Ω to 2000Ω, so that signals transmitted from external device 59 are not shorted out and so signals transmitted from transmitter 50 can be received at device 59. HART® Smart Communications Protocol Voltage Mode Physical Layer Specification referenced above defines the preferred output impedance range for the extended frequency band. Alternative communications standards dictate other impedance levels.

In FIG. 2, signal 76 is coupled to circuit 100 at resistor 112 and is connected to a current summing junction which is controlled to supply **63*b* due to action of opamp 114. Similarly, signal 74 is coupled to circuit 100 at resistors 116,118 and is connected to the same current summing junction. Resistor values 112,116,118 are selected so that the value of resistor 112 is approximately 128 times larger than the value of the combination of resistors 116,118. The ratio of 128 is selected to correspond with the selection of 7 bits (or equivalently, 128) in the lower word, represented serially on signal 76. Accordingly, resistor 112 has value of 8.25 MΩ and the summation of the values of resistors 116,118** is approximately 64 kΩ, although other appropriate values can be calculated.

Because the potential at signal terminal 68 is typically 1–5V, the 400 mV–600 mV peak-to-peak AC signal as measured across the HART defined test load of 500 in series with 10 μF, may be superimposed on the substantially DC potential at terminal 68 to provide simultaneous AC communications on the effective DC signal. The maximum peak of the simultaneous AC and DC signal remains less than substantially the potential at supply terminal 66 and the minimum peak remains greater than substantially the potential at common terminal 69, so the simultaneous signal does not saturate at maximum and minimum potential values. Transmitter 50 outputs an effective DC signal exceeding 5V when an error condition occurs and during such time, simultaneously transmitted AC signals will create a transmitter output potential which is flattened at the maximums and minimums of such signal.

What is claimed is:

1. A three wire transmitter bidirectionally communicating AC signals to and from a first device external to the transmitter, and sending DC signals thereto, comprising:

a power terminal and a common terminal connected to corresponding power and common terminals of an energization source external to the transmitter;

sensing means, energized from the power terminal and the common terminal, for providing a sensor output indicative of a process variable (PV) sensed by the sensing means; and communication means energized from the power terminal and the common terminal, including means for storing transmitter data for the transmitter, the communication means receiving the sensor output for providing a DC signal and a first AC signal to a signal terminal connected to the first external device, and receiving a second AC signal from the first external device, the DC signal representative of the sensed PV and the first AC signal representative of the sensed PV and of transmitter data selected by the second AC signal, the communication means having a characteristic AC impedance between the signal terminal and the common terminal for receiving and transmitting the first and second AC signals to and from the first external device so that the second AC signal is of a sufficiently large amplitude and so the first AC signal is received, the communication means having a characteristic DC impedance substantially lower than the DC impedance of the first external device for transmitting the DC signal.

2. A three wire transmitter bidirectionally communicating AC signals to and from a first device external to the transmitter, and sending DC signals to a second external device, comprising:

a power and a common terminal connected to corresponding power and common terminals of an energization source external to the transmitter;

sensing means, energized from the power terminal and the common terminal, for providing a sensor output indicative of a process variable (PV) sensed by the sensing means; and communication means energized from the power terminal and the common terminal, including means for storing transmitter data for the transmitter, the communication means receiving the sensor output for providing a DC signal and a first AC signal to a signal terminal connected to both external devices, and receiving a second AC signal from the first external device, the DC signal representative of the sensed PV and the first AC signal representative of the sensed PV and of transmitter data selected by the second AC signal, the communication means having a characteristic AC impedance between the signal terminal and the common terminal for receiving and transmitting the first and second AC signals to and from the first external device so that the second AC signal is of a sufficiently large amplitude and so the first AC signal is received, the communication means having a characteristic DC impedance substantially lower than the DC impedance of the second external device for transmitting the DC signal.

3. A three wire transmitter as recited in claim 1 or 2 where the communication means includes a microcomputer for storing status and performance information about the transmitter and for receiving requests from and sending a response to the first external device regarding a status of the transmitter.

4. A three wire transmitter as recited in claim 1 or 2 where the power drawn from the energization source does not exceed 0.040 Watts.

5. A three wire transmittier as recited in claim 1 or 2 where the communication means further comprises D/A means through which the sensor output is coupled for pulse width encoding the sensor output.

6. A three wire transmitter as recited in claim 1 or 2 where the communication means further comprise modem means through which the sensor output is coupled for FSK encoding the sensor output.

7. A three wire transmitter as recited in claim 1 or 2 where the communication means further comprise wave shaping means through which the FSK output is coupled for wave shaping.

8. A three wire transmitter as recited in claim 1 or 2 where the AC signals are formatted according to the HART® protocol.

9. A three wire transmitter as claimed in claim 1 or 2 where the characteristic AC impedance is larger than the characteristic DC impedance.

10. A three wire transmitter as claimed in claim 1 or 2 where the value of the characteristic AC impedance is between 1000Ω and 2000Ω for frequencies between 500 Hz–10 KHz.

11. A three wire transmitter as claimed in claim 1 or 2 where the value of the characteristic DC impedance is substantially 0 ohms for frequencies between 0 and 20 Hz.

* * * * *

UNITED STATES PATENT AND TRADEMARK OFFICE

CERTIFICATE OF CORRECTION

PATENT NO. : 5,245,333

DATED : September 14, 1993

INVENTOR(S) : Stephen D. Anderson et al.

It is certified that error appears in the above-indentified patent and that said Letters Patent is hereby corrected as shown below:

Col. 4, Line 5, cancel "8", and insert --84--.

Col. 5, Line 20, cancel "preferably", and insert --preferable--.

Signed and Sealed this

Twenty-sixth Day of April, 1994

*Attest:*

*Attesting Officer*

Bruce Lehman

BRUCE LEHMAN

*Commissioner of Patents and Trademarks*